United States Patent [19]

Herbig

[11] 4,324,016

[45] Apr. 13, 1982

[54] SELF-WRINGING MOP

[75] Inventor: Eugene O. Herbig, Belleville, Ill.

[73] Assignee: Royal Maid, Inc., Hazlehurst, Miss.

[21] Appl. No.: 181,385

[22] Filed: Aug. 22, 1980

[51] Int. Cl.[3] ..... A47L 13/146

[52] U.S. Cl. ..... 15/119 A

[58] Field of Search ..... 15/116 R, 116 A, 119 R, 15/119 A

[56] References Cited

U.S. PATENT DOCUMENTS

| | | | |
|---|---|---|---|
| 2,695,417 | 11/1954 | Bathurst | 15/119 A |
| 2,896,235 | 7/1959 | Clements | 15/116 A |
| 3,089,171 | 5/1963 | Vosbikian et al. | 15/119 A |
| 4,181,999 | 1/1980 | Maust et al. | 15/119 A |

FOREIGN PATENT DOCUMENTS

| | | | |
|---|---|---|---|
| 618522 | 3/1961 | Italy | 15/116 A |

*Primary Examiner*—Edward L. Roberts

[57] ABSTRACT

A mop is disclosed of the self-wringing type having a mop head attached to a handle on which a manually contactable sleeve is slidably positioned. The sleeve is connected to a squeeze plate via a mechanical linkage which acts to increase the mechanical advantage and, thus, the force by which the squeeze plate engages a sponge element carried by the mop head as it is rotated into engagement therewith.

4 Claims, 8 Drawing Figures

SELF-WRINGING MOP

BACKGROUND OF THE INVENTION

This invention relates to mops, and, more particularly, to improvements in self-wringing wet mops. Wet mops of the type to which this invention pertains comprise a cellulosic sponge or similar absorbent material secured to the end of a mop handle which is saturated with a solution of water and soap or detergent by immersing same in a bucket containing the solution. After the sponge has picked up a quantity of dirt from the surface to which it has been applied, the sponge is returned to the solution for rinsing or the water is forced out above the bucket, leaving the sponge in a condition to absorb any water remaining on the surface. This operation is repeated as often as necessary. Due to the often high temperature of the water, strength of the soap or detergent and frequency of the wringing operation, it is very desirable to provide the mop with a means of squeezing the excess water from the sponge quickly, easily and completely without the operator having to bend over or the operator's hands coming in contact with the solution.

DESCRIPTION OF THE PRIOR ART AND OBJECTS

A number of devices having mop handle mounted actuators have been developed which enable the sponge to be squeezed by the operator. While several of these wringing mechanisms have been somewhat effective, none has been entirely free of defects in one respect or another. Those of the butterfly type, such as that shown in U.S. Pat. No. 2,858,557, employ a split swabbing element which requires a large space between the hinged members making the mop head too large to be effectively rinsed in buckets of conventional size. Other prior art mechanisms do not effect a thorough squeezing of the entire sponge, such as the mop shown in U.S. Pat. No. 2,716,768, wherein the squeeze plate is hinged along one edge adjacent the sponge which must necessarily result in that portion of the sponge being subject to more compressive force than the portion furthermost from the hinge, resulting in uneven squeezing. Still other proposed mechanisms which attempt to provide even squeezing of the sponge by bringing the squeeze plate normal to the sponge surface as shown, for example, in U.S. Pat. No. 2,896,235, are very unwieldy in that the squeeze plate must be rotated from its parked position in a large arc, thus making complete actuation difficult, if not impossible, in the confined space of most rinsing buckets.

The present invention avoids the aforementioned difficulties associated with prior art mops and their wringing mechanisms by providing a compact novel mop handle mounted actuator, link mechanism and squeeze plate which effectively and uniformly squeezes moisture from the sponge cells.

An object of this invention, therefore, is to provide a self-wringing mop mechanism which approaches uniform compression of the sponge element.

It is another object of this invention to provide a wringing mechanism for a mop which, due to a novel linkage arrangement, amplifies the compressive force exerted against the sponge element with no additional effort required by the operator.

An additional object of this invention is to provide a mop wringing mechanism having a squeezing element which can be actuated for rinsing the sponge element while the entire mechanism is submerged in a bucket of conventional size containing cleaning solution.

A further object of this invention is to provide a self-wringing mop whose actuating means does not require the operator's hands to touch the cleaning solution or be changed from their normal mopping position.

Yet another object of the present invention is to provide a strong, rugged and durable mop of the character described, which shall be relatively inexpensive to manufacture, easy to manipulate, and which shall be practical and efficient in use.

These and other objects and advantages of my invention will be apparent from a consideration of the specification in conjunction with the drawings in which:

FIG. 5(*b*) is a side view of the mop wringing mechanism at its approximate midpoint of travel;

FIG. 5(*c*) is a side view of the mop wringing mechanism in its start clamp position, and FIG. 5(*d*) is a side view of the mop wringing mechanism in its clamp or sponge wringing position.

DETAILED DESCRIPTION OF THE INVENTION

Figure 2:
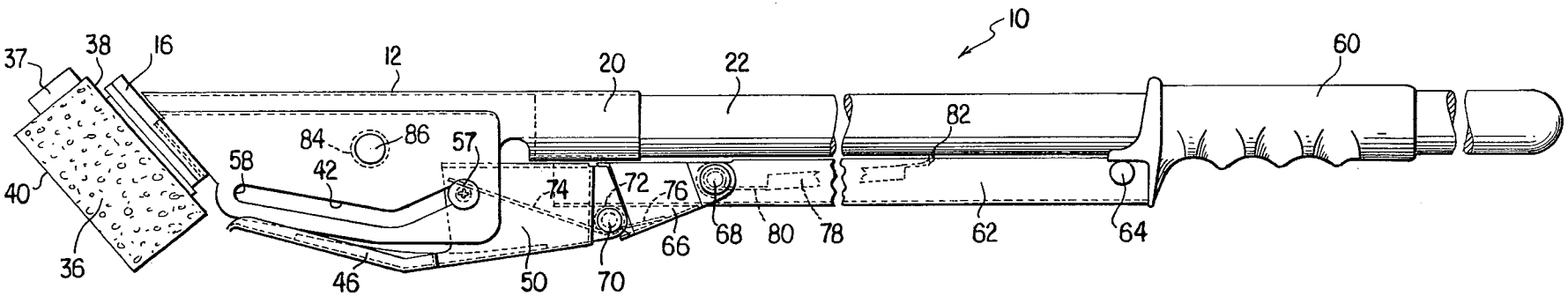
FIG. 2 is a side elevational view of the self-wringing mop of FIG. 1.
Figure 1:
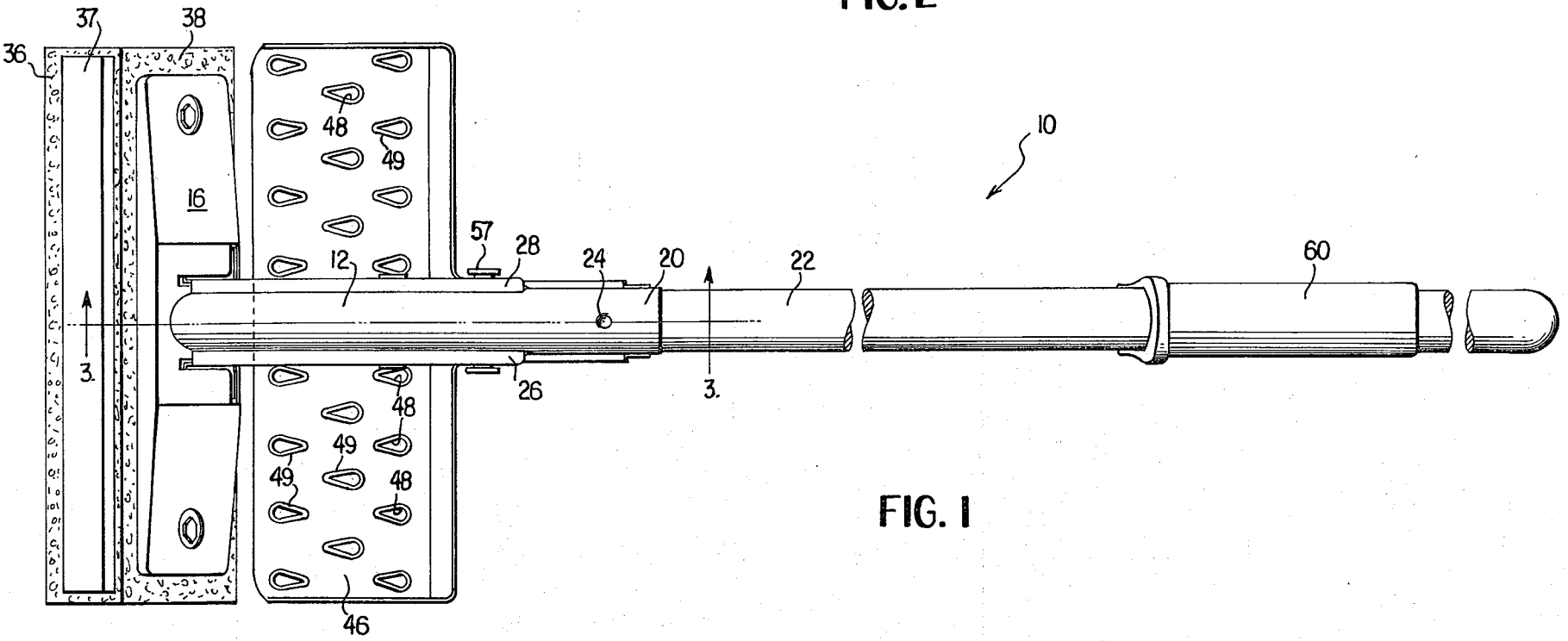
FIG. 1 is a plan view of a combined mop and wringing mechanism of the present invention with the handle broken away to condense the drawing.
Figure 3:
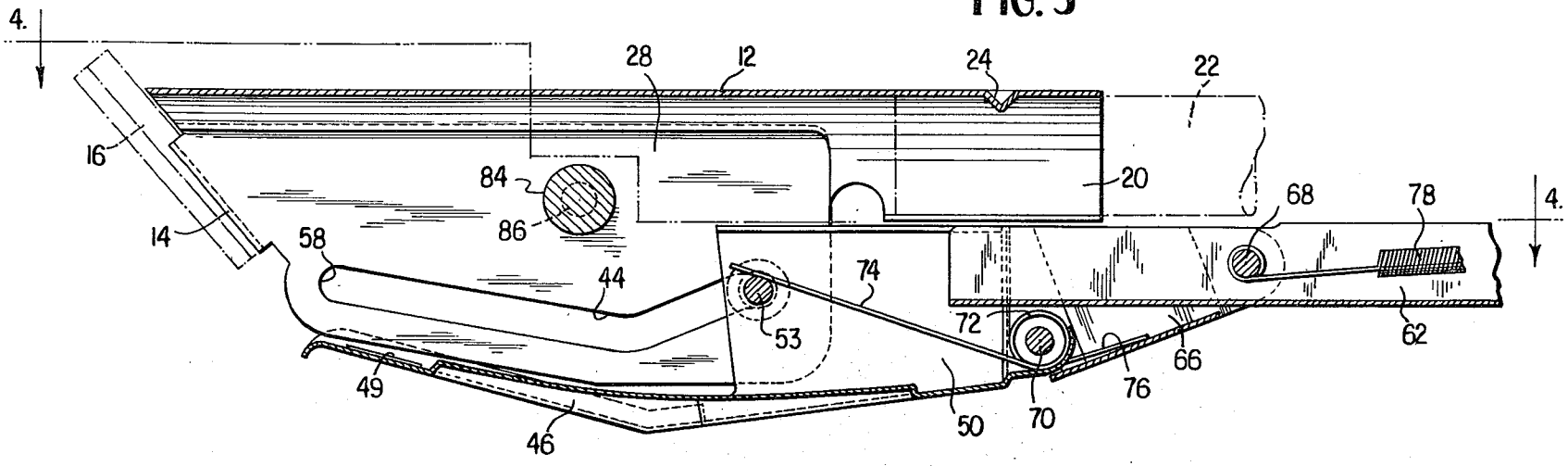
FIG. 3 is a cross-sectional view of the self-wringing mop of the present invention taken along lines 3—3 of FIG. 1.
Figure 4:
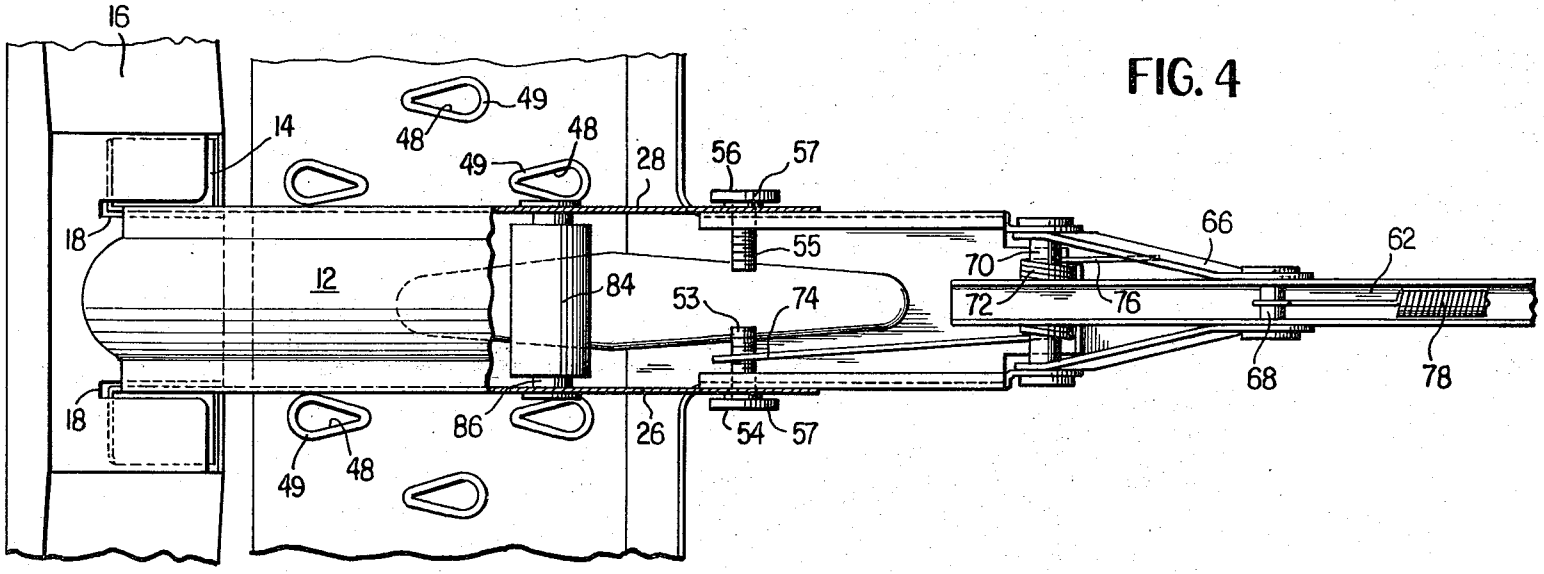
FIG. 4 is a view in partial cross-section taken along the lines 4—4 of FIG. 3.

Referring now in more detail to the illustrated embodiment where similar characters of reference indicate like elements in each of the several views, FIGS. 1 through 4 show the mop 10 of the present invention. The mop 10 is of the self-wringing type and has a mop head 12 formed preferably of sheet metal. The mop head 12 has tabs 14 formed on one end thereof to which is secured a rectangularly shaped carrier-plate 16. The tabs 14 extend through slots 18 in the carrier plate 14 and are welded or otherwise secured to the underside thereof. The mop head 12 has a cylindrical portion 20 formed on its other end into which is secured one end of an elongated cylindrically shaped handle 22 made of wood or tubular metal. The handle 22 is held in the cylindrically shaped portion by means of a crimp and dimple 24.

The mop head 12 also has two parallel, spaced-apart side plates 26 and 28 integrally formed along one edge thereof. An elongated cleaning element 36 in the form of, for example, a synthetic sponge is attached to the underside of the carrier plate 16. The cleaning element 36 has substantially rectangularly-shaped sides, one of the largest of which 38 is positioned adjacent to and slightly overlapping the edges of the carrier plate 16. The other large side 40 serves as the cleaning surface which normally engages the surface to be mopped. The plane of the side 38 is substantially parallel to the plane of the carrier plate 16. The cleaning element 36 can also be equipped with a scrubber strip 47 secured thereto of semi-abrasive material to loosen dirt prior to being picked up on side 40.

The side plates 26, 28 each have oppositely disposed, longitudinally extending slots 42, 44 respectively, for supporting a portion of the wringing mechanism for the mop which will now be described. The central element of the wringing mechanism is a squeeze plate 46 made of sturdy sheet metal and having a plurality of circular recesses 48 therethrough in a forward cleaning element contacting portion thereof to permit the passage of a cleaning solution from the cleaning element 36. Adjacent to and extending around each recess 48 in squeeze plate 46 are indented bases 49 which serve to lend rigidity to the squeeze plate 46 during its operation. The squeeze plate 46 has two spaced apart flange members 50, 52 integrally formed therewith and extending normal and rearwardly of said portion containing said recesses thereto. Screws 54, 56 have threaded shanks 53, 55, respectively, which extend through slots 42, 44 and are anchored in perpendicular fashion into flange members 50, 52 respectively. The screw shanks 53, 55, when positioned in their respective slots 42, 44 enable the squeeze plate 46 to reciprocate back and forth relative to cylindrical portion 20 and handle 22. The ends 58 of the slots 42, 44 serve as pivot points for the screw shanks 53, 55 and enable the squeeze plate 46 to rotate with respect to the mop head 12. The screws 54, 56 have heads 57 which are greater in diameter than the width of slots 42, 44 thereby helping to maintain flange members 50, 52 in a position parallel to each other. In order to move the squeeze plate 46 in the reciprocating and rotating maneuver aforementioned, an actuating mechanism is provided. The actuating mechanism comprises a hand contactable element 60 in the form of a sleeve which is slidably positioned on handle 22. The sleeve 60 can be made of sheet metal or other suitable material such as a molded plastic. A first link member 62 is secured to the sleeve 60 by means of a rivet 64. A second link member 66 is also provided, one end of which is secured for rotation relative to the other end of the first link member 62 by means of a pivot pin 68. The second link member 66 is substantially U-shaped and connected between side plates 26, 28 and secured for rotation relative thereto by means of a pivot pin 70. A coil spring 72 is positioned on the pivot pin 70 such that one end 74 thereof bears against the tubular member 53 and the other end 76 bears against the second link member 66. The coil spring 72 acts to bias the squeeze plate 46 and second link member 66 in the direction wherein their respective longitudinal axes are approaching parallelism. To assist further in maintaining the squeeze plate 46 and hand contactable element 60 in the retracted position, a tension spring 78 is also provided having one end 80 in engagement with pivot pin 68 and the other end 82 secured to handle 22.

Figure 5A:
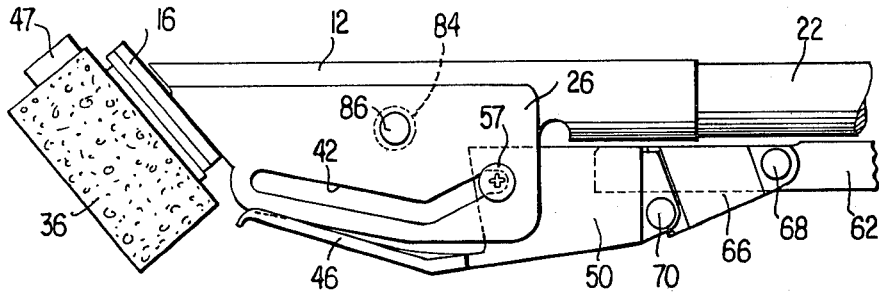
FIG. 5(*a*) is a side view of the mop wringing mechanism at its parked position.
Figure 5B:
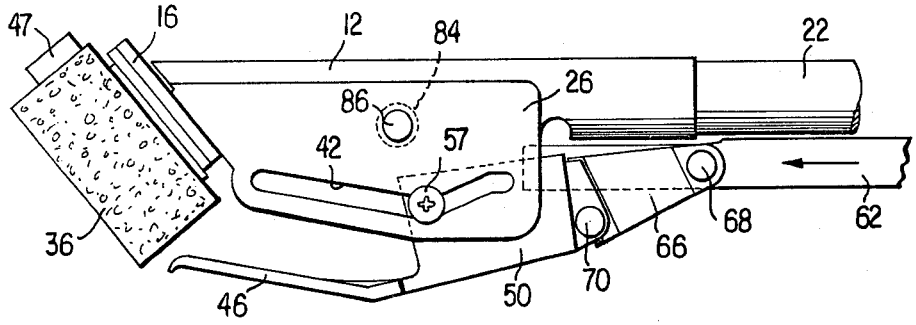
Figure 5C:
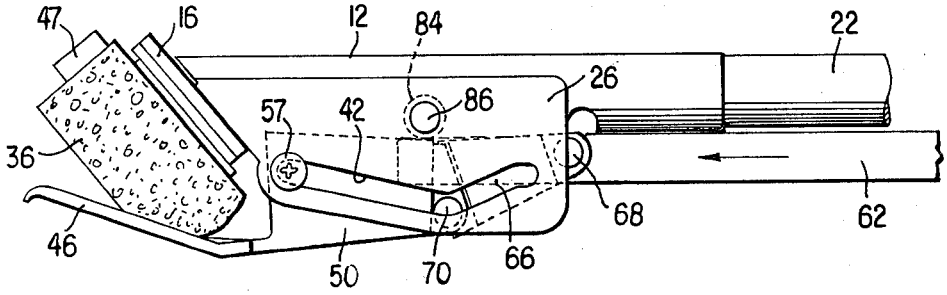

The operation of the self-wringing mop of the present invention can best be understood by referring to FIGS. 5*a*, 5*b* and 5*c*. In FIG. 5*a*, the squeeze plate 46 is shown in its open or fully retracted position. The squeeze plate 46 is maintained in this, the open, position by means of springs 72, 78 as aforementioned.

In this open position, the cleaning element 36 can be submersed in the cleaning solution and then applied to the surface to be cleaned. As can be seen, the squeeze plate 46 is close to the bottom of the mop head 12 and handle 22 is out of the way so as not to interfere with either the saturation of the cleaning element 36 or its use.

When the operator desires to squeeze out the used cleaning solution and rinse the dirt from the cleaning surface 40 of the mop head 12, the handle 22 is grasped and the hand contactable element 60 shoved downward (see arrow) toward the mop head 12. Motion of the hand contactable element 60 downward causes first and second link members 62 and 66 respectively to move the squeeze plate 46 from the "open" position shown in FIG. 5*a* to the "intermediate" position shown in FIG. 5*b*, wherein the squeeze plate 46 is moved away from the mop head 12 to permit the squeeze plate 46 to clear most of the cleaning element 36 before coming into squeezing engagement with that cleaning element. Continued forward motion of the hand contactable element 60 moves the squeeze plate to the "start clamp" position shown in FIG. 5*c*. The "start clamp" position is reached when the threaded shanks 53 and 55 reach the pivot points 58 of the elongated slots 42 and 44, respectively.

Figure 5D:
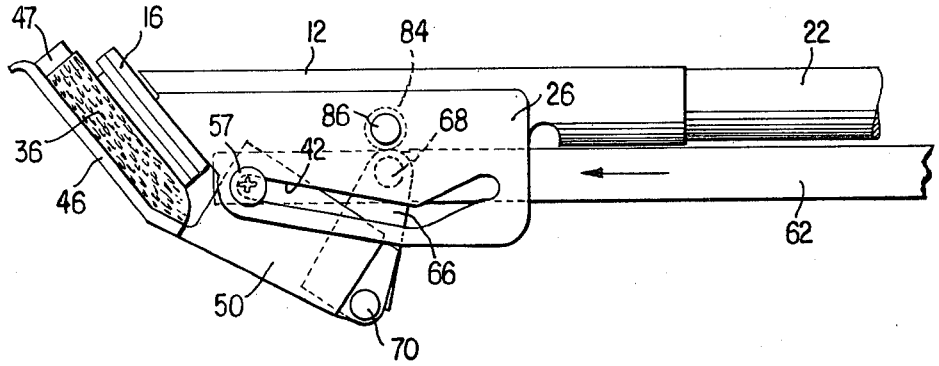

As the hand contactable element 60 is shoved further, the squeeze plate 46 is caused to rotate by the action of second link member 66 into engagement with the cleaning surface 40 of cleaning element 36. Continued downward movement of the hand contactable element 60 and the force thereby applied is transmitted to the squeeze plate 46 and greatly amplified by the mechanical advantage produced by the pivoting motion of the second link member 66 relative to the first link member 62 and squeeze plate 46. This increase in force applied to the squeeze plate 46 as it is moved to its "clamp position" results in a complete squeezing of the cleaning element 36. To insure that all of the force is transmitted thrugh the second link member 66, a roller 84 is provided, rotatably mounted on a pin 86. When the squeeze plate 46 is approaching the end of its travel, the link 62 is wedged under roller 84, as shown best in FIG. 5*d*, to insure complete clamping and squeezing action of the squeeze plate 46 against cleaning element 36.

After the cleaning element 36 has been thoroughly rinsed out by repeated reciprocating movement of the hand contatable element 60, the squeeze plate 46 is drawn to and parked in its "open" position. The actions of coil spring 72 and tension spring 78 tend to keep the threaded shanks 53 and 55 in alignment with pivot pin 68 in this parked or "open" position.

It can be seen that a device constructed in accordance with my invention provides a simple and effective method of wringing cleaning solution from a cleaning element on a mop head. Furthermore, it will be noted that because the squeeze plate engages the cleaning element in a substantially perpendicular manner with amplified force, the compression of the cleaning element is nearly uniform, without creating shearing stress that could damage the cleaning element. And, finally, because the operating area of the squeeze plate is maintained close to the mop head, the rinsing action can be accomplished in a relatively small bucket, without the operator's hands ever touching the cleaning solution or mop head.

The present invention has been described in detail above for purposes of illustration only and is not intended to be limited by this description or otherwise to exclude any variation or equivalent arrangement that would be apparent from or reasonably suggested by the foregoing disclosure to the skilled of the art.

What I claim is:

1. A self-wringing mop comprising:

(a) a mop head member having a mop handle attached to one end of said head member and a carrier plate attached to the other end thereof, said head having two depending, spaced-apart side walls, each of said side walls having an elongated slot formed therein substantially parallel to said head portion;

(b) an elongated cleaning element attached to said carrier plate, (c) a squeeze plate having a forward cleaning element contacting portion positioned between said side walls and slidably mounted in said slot between ends thereof and a rearward portion, (d) a hand contactable element slidably engaging said mop handle, (e) first link member pivotably connected at one end to said rearward portion of said squeeze plate, and (f) second link member pivotably connected to said other end of said first link member and to said hand contactable element, said pivotal connection at said one end and said other end of said first link member being such that sliding movement of said hand contactable element will cause said squeeze plate, upon reaching said end of said slot, to pivot toward said cleaning element and continued sliding movement of said hand contactable element will cause said first link member to continue to pivot relative to said squeeze plate and said second link member to effect a substantial increase in the mechanical advantage and thus the squeezing force transmitted by said squeeze plate to said cleaning element.

2. The structure defined in claim 1 further comprising spring means acting between said first link member and said squeeze plate to facilitate the return of said squeeze plate to a position parallel to the longitudinal axis of said handle after squeezing of said elongated cleaning element.

3. The structure defined in claim 1 further comprising roller means rotatably mounted between said side walls, said roller means serving as a support engageable by said first link means to insure complete closure of said squeeze plate against said cleaning element.

4. The structure defined in claim 1 wherein said squeeze plate is formed with a series of openings to permit water to pass therethrough, each such opening having an embossment around it to enhance the overall rigidity of said squeeze plate.

* * * * *